US005555900A

United States Patent [19]

Rich

[11] Patent Number: 5,555,900

[45] Date of Patent: Sep. 17, 1996

[54] COSMETIC SKIN STRETCHING APPLIANCE AND METHOD OF USE

[76] Inventor: Willard P. Rich, 2500 NE. Ninth St., Apt. 204, Fort Lauderdale, Fla. 33304

[21] Appl. No.: 423,045

[22] Filed: Apr. 17, 1995

[51] Int. Cl.[6] ..... A45D 24/00

[52] U.S. Cl. ..... 132/200; 132/53; 606/204.35

[58] Field of Search ..... 132/53, 58, 57.1, 132/59, 60, 61, 64.1, 66.1, 71.1, 200; 606/204.35

[56] References Cited

U.S. PATENT DOCUMENTS

| | | | |
|---|---|---|---|
| 1,356,112 | 10/1920 | Boisvert et al. | 606/204.35 |
| 1,563,767 | 12/1925 | MacDonald | 606/204.35 |
| 3,154,071 | 10/1964 | Haagen | 606/204.35 |
| 3,575,164 | 4/1971 | Heale | 606/204.35 |
| 3,584,619 | 6/1971 | Bowser, Jr. | 606/204.35 |
| 3,672,363 | 6/1972 | Masters | 606/204.35 |
| 3,736,925 | 6/1973 | Erman | 606/204.35 |
| 3,782,396 | 1/1974 | Tomlinson | 132/53 |
| 4,239,037 | 12/1980 | Fausone | 606/204.35 |
| 4,658,841 | 4/1987 | Won | 132/53 |
| 5,337,763 | 8/1994 | Haber | 132/53 |

*Primary Examiner*—Gene Mancene
*Assistant Examiner*—Philogene Pedro
*Attorney, Agent, or Firm*—McAulay Fisher Nissen Goldberg & Kiel, LLP

[57] ABSTRACT

A cosmetic method utilizes a skin-stretching appliance including a band having a first adhesive strip, patch or pad at a first end of the band and a second adhesive strip, patch or pad at an opposite end of the band. The method also utilizes a covering such as an article of clothing or a wig for a body part of a user. The covering is attached to the band during normal use of the device. The first adhesive strip is attached to a first location on a first side of the body part, and then a first skin area of the body part on the first side of the body part is stretched. Subsequently, a second skin are of the body part on a second side of the body part substantially opposed to the first side of the body part is stretched, and the second adhesive strip is fastened to a second location on the second side of the body part. By virtue of the band and the attached adhesive strips, a stretching force is maintained on the first skin area and the second skin area to at least reduce wrinkles at those areas. Also by virtue of the band and the attached adhesive strips, the covering is held in position on the body part.

4 Claims, 2 Drawing Sheets

COSMETIC SKIN STRETCHING APPLIANCE AND METHOD OF USE

BACKGROUND OF THE INVENTION

This invention relates to a cosmetic skin stretching appliance. This invention also relates to a cosmetic method utilizing the appliance.

One of the disappointments of aging, for many people, is the loss of certain attributes of youth, including particularly, the smooth wrinkle-free skin of youth. In an effort to help people present a more youthful appearance, several approaches have been undertaken to eliminate or reduce wrinkles. These approaches include plastic surgery and cosmetic creams and lotions. Both of these solutions, particularly surgery, can be quite expensive. Surgery is generally too expensive for most people. With respect to topical applications, there is certainly substantial doubt as to their efficacy.

A device or methodology for at least reducing the wrinkles of age is needed which is inexpensive and easy to use.

OBJECTS OF THE INVENTION

An object of the present invention is to provide a cosmetic type device which can reduce skin wrinkles during use of the device.

A more particular object of the present invention is to provide such a cosmetic type device which can be used to temporarily reduce skin wrinkles in the facial and neck areas.

Another object of the present invention is to provide such a cosmetic device which may be hidden.

Yet another particular object of the present invention is to provide a method for temporarily reducing skin wrinkles in certain areas of the body.

These and other objects of the present invention will be apparent from the drawings and detailed descriptions herein.

SUMMARY OF THE INVENTION

A cosmetic device comprises, in accordance with the present invention, a band, attachment elements at opposite ends of the band for removably attaching the band to respective skin surfaces of a user, a covering for a body part of the user, and a coupling structure in or on the covering for removably coupling the band to the covering.

According to another feature of the present invention, the band includes a first end section and a second end section and componentry such as VELCRO™ type hook and loop fasteners for releasably securing the first end section to the second end section.

Preferably, the attachment elements at the opposite ends of the band are adhesive strips. The adhesive layers on the strips as well as the substrate material of the strips are preferably made of a biocompatible material. Many such materials are known in the medical field.

According to a further feature of the present invention, the covering is an article of clothing such as a scarf. In that case, the attachment elements or adhesive strips are fastened to skin surfaces on substantially opposite sides of the user's neck. The band is attached to the scarf by passing through eyelets provided on the scarf. The eyelets may be reinforced with stitching and patches. Upon fastening of the attachment elements or adhesive strips to the substantially opposed skin surfaces on the user's neck, the scarf is folded to hide the band.

The covering may take the form of a wig. In that case, the coupling structure by which the band is attached to the wig includes a plurality of loops provided along an inner side of the wig. Preferably, the loops are provided in temple regions and at a crown of the wig.

The adhesive strips may be provided with removable cover strips to protect the adhesive layers prior to use.

A cosmetic method in accordance with the present invention utilizes a band having a first adhesive strip, patch or pad at a first end of the band and a second adhesive strip, patch or pad at an opposite end of the band. The method also utilizes a covering such as an article of clothing or a wig for a body part of a user. The covering is attached to the band during normal use of the device. The cosmetic method in accordance with the present invention includes the steps of (a}) attaching the first adhesive strip to a first location on a first side of the body part, (b}) initially stretching a first skin area of the body part on the first side of the body part, (c}) subsequently stretching a second skin area of the body part on a second side of the body part substantially opposed to the first side of the body part, and (d}) fastening the second adhesive strip to a second location on the second side of the body part. Because of or by virtue of the band, the first adhesive strip attached to the body part at the first location and the second adhesive strip attached to the body part at the second location, a stretching force is maintained on the first skin area and the second skin area to at least reduce wrinkles in the first skin area and the second skin area. Also by virtue of the band, the first adhesive strip attached to the body part at the first location and the second adhesive strip attached to the body part at the second location, the covering is held in position on the body part.

Pursuant to another feature of the present invention, the method includes the step of coupling the covering to the band. The band is inserted through eyelets provided on the article of clothing (e.g., a scarf) or the wig.

Where the covering is a wig, the body part is the user's head and the first skin area and the second skin area include respective cheek areas of the user's face. The adhesive strips are attached to the user's head at the temples and the method further comprises the step of placing the wig on the user's head.

Where the covering is a scarf and the body part is the neck, the skin areas are on substantially opposed sides of the user's neck. The method further comprises the step of placing the scarf on the user's neck.

Generally, it is contemplated that the step of initially stretching (the first skin area) is performed before and after the attaching of the first adhesive strip at the first location on the body part. The prior stretching is used to determine proper placement of the first adhesive strip. The stretching after the attachment of the first adhesive strip may accompany the stretching of skin of the other side of the user's body part prior to and during application of the second adhesive strip to the body part. Accordingly, where the user is applying the apparatus to stretch and smooth out neck skin, an adhesive strip, patch or pad at one end of the band is attached to a skin surface on a first side of the user's neck. Prior to fastening of the other adhesive strip, patch or pad to a second, substantially opposite side of the neck, the skin of the front side of the neck is stretched. This stretching is accomplished at least on the second side of the user's neck by the application of pressure via the finger tips. On the first side of the neck, the pressure may be applied at least in part via the band and the attached adhesive strip. Generally, it is contemplated that the covering, i.e., the scarf, is attached to the band prior to the fastening of the adhesive strips to the user's neck.

Where the user is applying the apparatus to stretch and smooth out facial skin, an adhesive strip, patch or pad at one end of the band is attached to the user's head at a first temple area. Prior to fastening of the other adhesive strip, patch or pad to a second temple area, the skin areas of the cheeks are stretched. This stretching is accomplished at the second temple area by the application of pressure via the finger tips. At the first temple area, the pressure may be applied at least in part via the band and the attached adhesive strip. Generally, it is contemplated that the covering, i.e., the wig, is attached to the band prior to the fastening of the adhesive strips to the user's temple areas. The band is inserted through loop eyelets along a concave inner surface of the wig.

Preferably, the band includes a first end section and a second end section releasably attached to one another. The method then further comprises the step of adjusting a length of the band by shifting the band sections relative to one another prior to the step of fastening. Generally, it is contemplated that the band is removed from the covering (scarf, wig, hat, collar, etc.) prior to the application of the adhesive strips in order to set the desired length of the band. The skin areas are stretched manually and the adhesive strips (with cover tabs) are positioned along the body part to determine the band length which will result in the desired skin stretching upon subsequent attachment of the adhesive strips to the skin. The sections of the band are then separated and reattached to arrive at the selected band length. To this end, the band sections may be VELCRO™ type hook and loop fastener strips.

Pursuant to an additional feature of the present invention, the method further comprises the step of hiding the band by the covering after completing the attachment of the band to the user. This step of hiding is accomplished naturally and as a matter of course where the covering is a wig. However, where the covering is an article of clothing such as a scarf, the scarf must be arranged about the neck of the user so that the band is not visible. According to one embodiment of the invention, the band is inserted through two eyelets provided in the scarf. Thus, a portion of the band may be visible on the outer side of the scarf prior to a folding or arrangement thereof as would naturally occur during scarf use.

A cosmetic type device in accordance with the present invention can reduce the number and extent of skin wrinkles during use of the device by stretching the skin. More specifically, a cosmetic type device in accordance with the present invention can be used to temporarily ameliorate or reduce the appearance of wrinkled skin in the facial and neck areas. In normal use, the stretching band is invisible, being hidden by a wig or an article of clothing such as a scarf, a hat, a collar, etc.

Some people will wish to use the device only on special occasions. Others will wish to make it a part of their daily cosmetic preparations or wardrobe.

It is to be further noted that the skin stretching appliance also serves to hold the covering to the person of the user. More particularly, the band helps to anchor a wig to a person's head or a scarf to a user's neck. Accordingly, it is important in use of the invention that the band be attached to a body covering, article of clothing, wig, etc.

DETAILED DESCRIPTION

Figure 1:
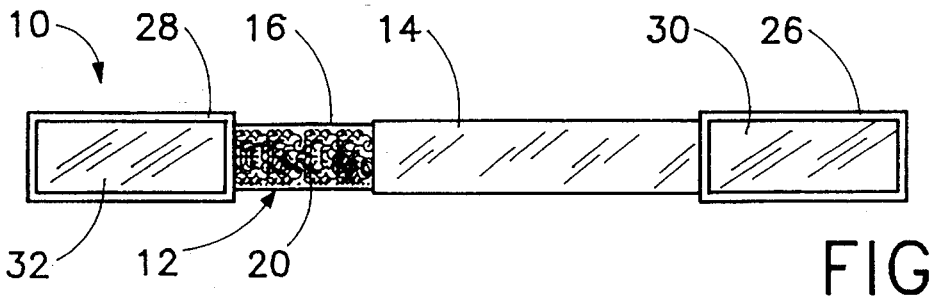
FIG. 1 is a plan view of a skin stretching band of a cosmetic device in accordance with the present invention.
Figure 2:
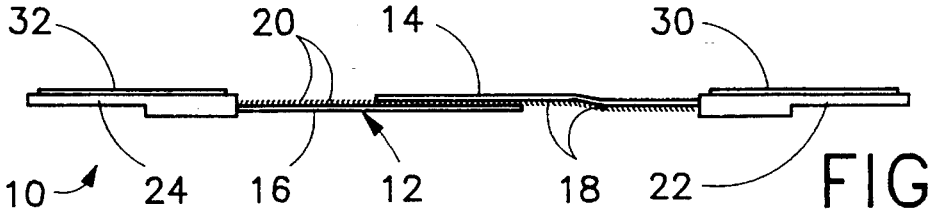
FIG. 2 is a side elevational view of the band of FIG. 1.

As illustrated in FIGS. 1 and 2, a cosmetic device 10 for stretching skin to remove or reduce wrinkles in the skin comprises a band 12 including a first end section 14 and a second end section 16 removably coupled to one another. End sections 14 and 16 preferably take the form of so-called VELCRO™ strips including aggregates of hook and loop type fastener elements 18 and 20. Each end section 14 and 16 is provided at one end with a respective attachment pad 22 or 24 made of a biocompatible flexible polymeric material.

Figure 3:
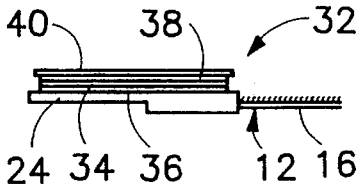
FIG. 3 is a partial side elevational view of the band of FIG. 1, showing a modification.

Attachment pads 22 and 24 have smooth major surfaces 26 and 28 which receive respective two-sided adhesive strips, patches or pads 30 and 32. As illustrated in FIG. 3, each adhesive strip 30 and 32 includes a body layer 34 provided on one side with a first adhesive layer 36 for securing the strip to attachment pad 22 or 24. On an opposite side, body layer 34 is provided with a second adhesive layer 38 for securing the strip 30 or 32, and accordingly pad 22 or 24, to a selected skin surface of a user. A cover sheet 40 may be provided over adhesive layer 38 for protecting that layer prior to use. Similarly, another cover sheet (not shown) may be provided on adhesive layer 36 for maintaining the integrity of that layer prior to the securing of strip 30 or 32 to the respective attachment pad 22 or 24.

Figure 4:
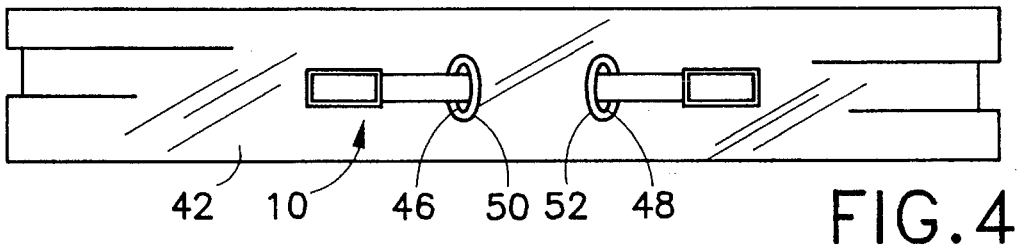
FIG. 4 is a plan view of a scarf incorporating the skin stretching band of FIGS. 1 and 2, thereby forming a cosmetic apparatus in accordance with the present invention.
Figure 5:
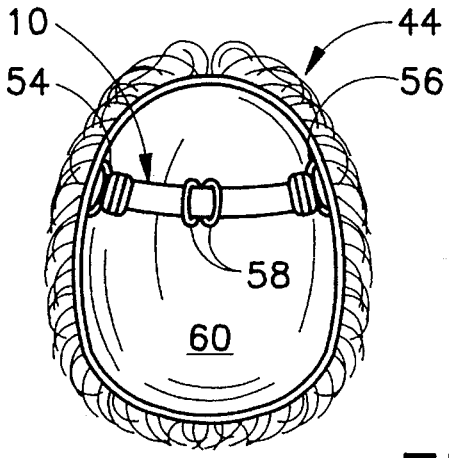
FIG. 5 is an under side view of a wig incorporating the skin stretching band of FIGS. 1 and 2, thereby forming another cosmetic apparatus in accordance with the present invention.

Attachment pads 22 and 24, with adhesive strips 30 and 32, are provided at opposite ends of band 12 for removably attaching the band to respective skin surfaces of a user. Cosmetic device 10 is removably attached to a covering in the form of an article of clothing such a scarf 42 (FIG. 4) or a wig 44 (FIG. 5). As illustrated in FIG. 4, a coupling structure in the form of a pair of eyelets or slits 46 and 48 is provided in or on scarf 42 for removably coupling band 12 to the scarf. Band 12 is inserted through eyelets 46 and 48. Eyelets 46 and 48 are surrounded by respective perforated reinforcement patches 50 and 52.

Figure 6A:
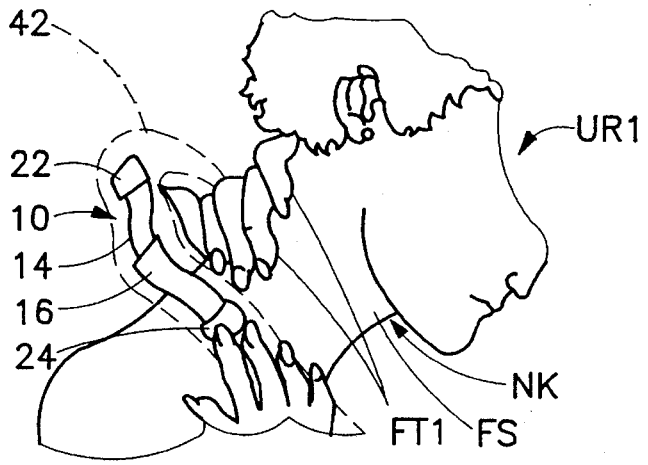
FIGS. 6A and 6B are schematic views of a person, showing successive steps in applying the cosmetic apparatus of FIG. 4.

As illustrated in FIG. 5, a coupling structure in the form of eyelets or loops 54, 56 and 58 is provided in or on an inner surface 60 of wig 44 for removably coupling band 12 to the wig. Band 12 traverses loops 54, 56 and 58. Loops 54 and 56 are triple stitched to the temple regions of wig 44, while a pair of loops 58 are triple stitched to the crown area of wig In a cosmetic method utilizing device 10 and scarf 42, scarf 42 is attached to band 12 during normal use of the device. As depicted in FIG. 6A, adhesive strip 32 is attached to a first side of the neck NK of a user UR1. Generally, it is contemplated that the locations of attachment of adhesive strips 30 and 32 on substantially opposite sides of the user's neck NK are predetermined by removing band 12 from scarf 42 and stretching the skin on the front side FS of the neck NK manually by the application of pressure via finger tips FT1. Concurrently with this stretching procedure, attachment pads 22 and 24, with their cover-protected adhesive strips 30 and 32, are juxtaposed to skin areas on the opposing sides of the user's neck NK to provide an estimate of a suitable length of band 12. Upon making such a determination, the user UR1 may adjust the length of band 12 by separating end sections 14 and 16 from one another and reattaching them in a longitudinally staggered configuration to form a band length corresponding to the desired degree of skin stretching. Band 12 may be removed from scarf 42 by first breaking the bonds between loop and hook fasteners 18 and 20.

Figure 6B:
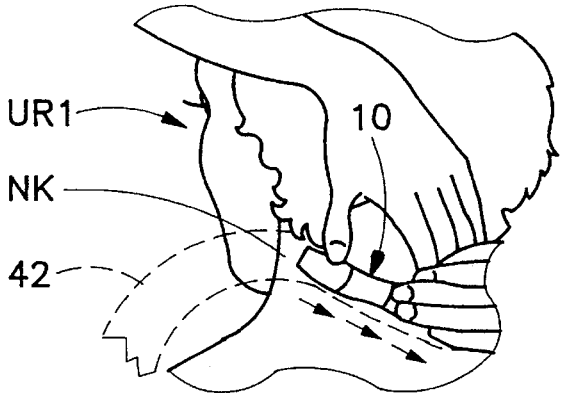

After the length of band 12 has been set, the band is reinserted through eyelets 46 and 48. Then, as illustrated in FIG. 6A, the fingertips FT1 are used to stretch skin along one side of the user's neck NK. Cover sheet 40 is removed from a first adhesive strip 32 and adhesive layer 38 is pressed to the skin surface, as shown. After a predetermined time (about one minute), the band is placed around the back side of the user's neck NK to extend to an opposite side of the neck NK, as indicated in FIG. 6B. Skin is stretched at that opposite side of the neck NK and adhesive strip 30 is pressed to the skin surface there, while maintaining suitable manual stretching pressure on the skin of the neck. Upon securing of attachment pads 22 and 24 to neck NK via adhesive strips 30 and 32, finger tips FT1 may be removed and scarf 42 folded or arranged to hide band 12. By virtue of band 12, and adhesive strips 30 and 32 attached to the user's neck NK, a stretching force is maintained on the skin areas on the left and right front sides of the user's neck NK to at least reduce wrinkles in those skin areas. Also by virtue of device 10, scarf 42 is held in position on the user's neck NK.

Figure 7C:
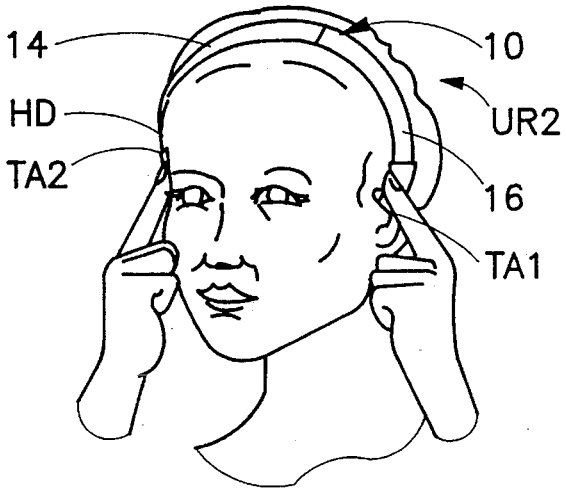
FIGS. 7A–7c are schematic views of a user, showing successive steps in applying the cosmetic apparatus of FIG. 5, with the wig omitted for purposes of facilitating illustration.
Figure 7A:
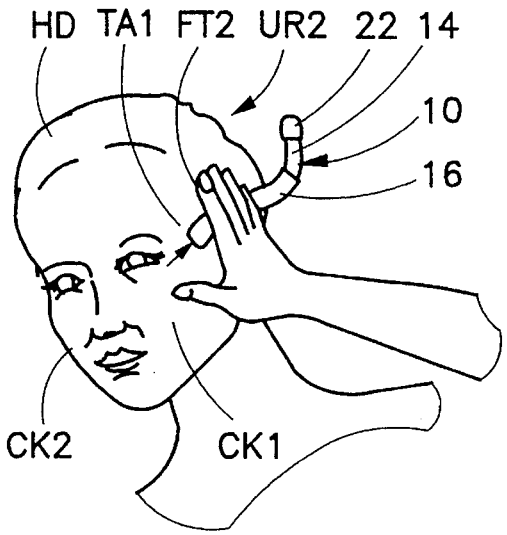
Figure 7B:
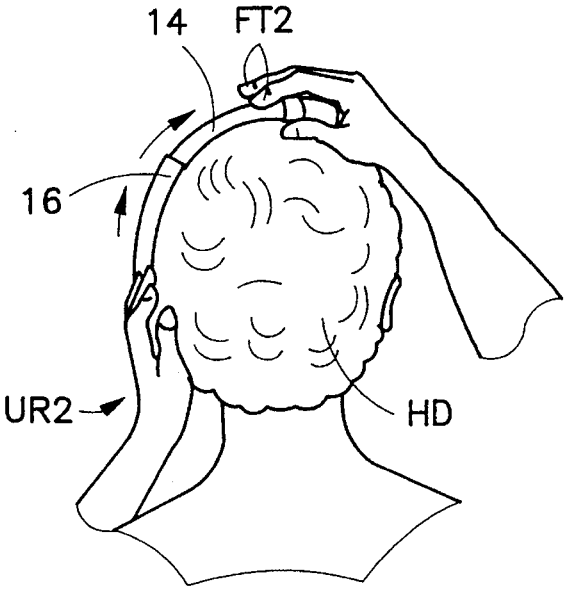

The above described method is essentially the same where cosmetic device 10 is incorporated in a wig 44 (FIG. 5). As illustrated in FIGS. 7A–7C, where the user UR2 is applying the apparatus to stretch and smooth out facial skin, particularly in the cheek areas CK1 and CK2, adhesive strip 32 is attached to the user's head HD at a first temple area TA1. Prior to fastening of the other adhesive strip 30 to a second temple area TA2, the skin areas of the cheeks CK1 and CK2 are stretched. This stretching is accomplished at the second temple area TA2 by the application of pressure via the finger tips FT2. At the first temple area TA1, the pressure may be applied via band 12 and the attached adhesive strip 32. Generally, it is contemplated that wig 44 is attached to band 12 prior to the afore-described procedure, and more specifically prior to the fastening of adhesive strips 30 and 32 to the user's temple areas TA1 and TA2. Band 12 is inserted through loops 54, 56 and 58 along inner surface 60 of wig 44.

As discussed above, the band is tested first, apart from wig 44, to determine a proper length of the band to provide the desired degree of cheek skin stretching. The length of the band 12 is adjusted by shifting band sections 14 and 16 relative to one another prior to the fastening of adhesive strips 30 and 32 to temple areas TA1 and TA2.

In the case of wig 44, the anchoring of the wig to the user's head HD by band 12 is especially advantageous, inasmuch as wig slippage is highly undesirable for the user UR2.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A cosmetic method comprising the steps of:

providing a substantially flexible band having an adjustable length and a first end and a second end opposite thereto;

further providing a covering for a body part of a user;

stretching a first skin area of said body part on a first side of said body part;

positioning said first end in juxtaposition to said first skin area at a first location on said first side of said body part;

stretching a second skin area of said body part on a second side of said body part substantially opposed to said first side of said body part;

positioning said second end in juxtaposition to said second skin area at a second location on said second side of said body part;

adjusting the length of said band to a length which will maintain the stretching of said first and second skin areas upon an attachment of said first end to one of said first location and said second location and said second end to the other of said first location and said second location;

after adjusting the length of said band, removing said band from said body part;

only upon completion of said steps of adjusting and removing, coupling said covering to said band; and adhering said first end to said one of said first and said second location and said second end to said other of said first and said second location, to maintain the stretching of said first and said second skin area and to hold said covering in position on said body part.

2. The method defined in claim 1 wherein said step of coupling includes the step of inserting said band through eyelets provided on said covering.

3. The method defined in claim 2 wherein said covering is a wig and said body part is the user's head and wherein said first skin area and said second skin area include respective cheek areas of the user's face, further comprising the step of placing said wig on the user's head, said first location and said second location being temple areas on the user's head.

4. The method defined in claim 2 wherein said covering is a scarf and said body part is the neck and wherein said first skin area and said second skin area include respective areas on substantially opposed sides of the user's neck, further comprising the step of placing said scarf on the user's neck.

* * * * *